United States Patent [19]

Wells et al.

[11] Patent Number: 5,038,708

[45] Date of Patent: Aug. 13, 1991

[54] APPARATUS FOR COATING THE INTERNAL SURFACES OF TUBULAR STRUCTURES

[75] Inventors: Stanley C. Wells, Dayton; David E. Spielvogel, Springboro; Paul M. Hendess, Kettering, all of Ohio

[73] Assignee: Becton, Dickinson and Company, Franklin Lakes, N.J.

[21] Appl. No.: 468,037

[22] Filed: Jan. 22, 1990

[51] Int. Cl.[5] ..... B05C 7/08; B05B 13/04; B05B 13/06

[52] U.S. Cl. ..... 118/318; 118/317; 118/313; 118/321; 118/323; 118/DIG. 10

[58] Field of Search ..... 118/313, 318, 317, 321, 118/323; 239/DIG. 13, 549

[56] References Cited

U.S. PATENT DOCUMENTS 2,336,946 12/1943 Marden et al. ..... 118/DIG. 10

4,233,932 11/1980 Blakeslee ..... 118/306

*Primary Examiner*—Karen M. Hastings

*Assistant Examiner*—Brenda Lamb

*Attorney, Agent, or Firm*—Robert P. Grindle

[57] ABSTRACT

Apparatus designed to coat the internal surfaces of tubular structures, and particularly for coating small diameter tubular structures having porous walls with a controlled coating material which may be a polymer, for example. The arrangement includes structure for rotating the tube to be coated simultaneously with structure for moving a coating applicator apparatus longitudinally through the tube for imparting an evenly dispersed coating throughout the longitudinally extent thereof. The arrangement is such that the apparatus may, selectively, impart a water or other solvent spray against, the already formed coating for extraction of a solvent from the coating. The coating characteristics (i.e., uniformity, thickness and pattern) are controlled by the use of a sintered metal and/or porous applicator, together with a controlled pressurized source of coating material.

13 Claims, 4 Drawing Sheets

APPARATUS FOR COATING THE INTERNAL SURFACES OF TUBULAR STRUCTURES

BACKGROUND AND STATEMENT OF THE INVENTION

This invention relates generally to methods and apparatus for coating the internal surfaces of tubular structures. More particularly, this invention relates to methods and apparatus for coating in a very controlled and precise manner the internal surfaces of very small diameter tubular structures such as, for example, vascular grafts. The configuration of the tube of interest may be circular in cross section or it may be somewhat elliptical if somewhat flexible, depending upon how the structure is formed in the first place.

One particular problem is the fact that while many grafts are solid, some are formed with a porous wall and the controlled application of the invention here is utilized to accommodate these variations.

In its broadest sense, the invention here includes the coating of the internal surfaces of tubular conduit-type structures since the structures to be coated are substantially longer than the diameter thereof and it is necessary to provide a precise consistent coating on the internal surface of the entire length of the tubular conduit. For example, tubular members, such as vascular grafts and common tubing used in medical applications, may have substantial length and require uniformity throughout the length thereof on the internal surfaces thereof.

Other tubular structures which may be coated internally with the methods and apparatus herein include textile circular braid, metallic or ceramic tubular substrates and other tubes which require internal coatings. Materials to impart biocompatibility, internal lubricity, optical viability, corrosion resistance, hydrophobic and hydrophilic interfaces and abrasion resistance are all applications appropriate for the methods and apparatus herein. While the invention here is not limited to specific coating materials, it is preferable that polymeric coatings are utilized for the various applications herein.

As mentioned previously above, the coating of the internal surfaces of vascular grafts is one particular application of the method and apparatus of the invention here. As is well known by practitioners in-the-art, vascular grafts come in a variety of configurations and compositions and it is important to be able to accommodate these various configurations and compositions and still coat the internal surface with a coating consistent and appropriate for the application of the graft in place in the human body. For example, grafts come with external reinforcement wrappings of small bonded rod stock and with convolutions in the walls thereof. Nevertheless, these grafts require certain coating applications internally for the use to which they are to be applied. The coating applications, in accordance with the methods and apparatus here, must be controlled to provide for the ultimate requirements of the device being coated for subsequent use.

In considering generally the conditions for carrying out the invention herein, it should be noted that the applicator for the invention is comprised, preferably, of a sintered brass material which provides the appropriate interstices for "applying" the polymer coating material against the internal surface of the graft. Other materials which may be utilized for the applicator include ceramic materials, zinc/nickel alloys and stainless steel. The material will be selected for the specific application and the chemical content of the coating material. Obviously, if the chemical content is such as to react with the material of the applicator head, it would deteriorate the head.

The arrangement herein is such that the tubular structure is mounted to hold the ends precisely in place and maintain the internal surface available for passage of the spray head therethrough. Subsequently, appropriate apparatus is started for moving the spray head longitudinally through the length of the material to be coated in a controlled manner not only with respect to the speed of movement, but also with respect to the degree of feeding of the coating material and the particular nature of the coating material. Obviously, as will be understood by practitioners-in-the-art, the viscosity of the coating material will be a factor in the speed by which the spray head is moved through the tubular substrate to be coated, and also the pressure under which the material is to be applied.

As a particular feature of the invention herein, in applications where the material for coating is a polymeric material with a solvent, provision is made for a simultaneous spraying with a water head against the already coated surface which water head moves through the internal surface of the material to be coated following the polymer spray head so that the solvent is washed from the polymer material immediately after its application to set the polymer coating and avoid any adherence between opposed surfaces of the internal tubular structure.

One of the problems of coating elongated tubular structures of the kind to which this invention is directed is the fact that there is a great longitudinal length compared to the length of the applicator or coating head for applying the coating. For this reason, the applicator head must pass through the length of the tube to be coated so that the internal surface thereof is evenly coated throughout the length. Also, for this reason, the tubular material to be coated must be held in place at each end thereof for maintaining a stable internal tubular surface for movement of the coating head. Moreover, provision is made selectively for the devices for holding each end of the elongated tube to be rotatable. The material to be coated may be rotated versus the applicator head for, again, evenly distributing the coating material on the internal surface of the tube being coated.

In this respect, generally prior art arrangements for coating the internal surface of structures require a spinning head for even application of a coating material to the internal surface of a hollow container, for example. Representative such devices are described and claimed in U.S. Pat. No. 4,233,932 which issued Nov. 18, 1980.

As purely illustrative of apparatus which may be used for carrying out this invention, one may note the attached drawings in which a representative device is illustrated for coating the internal surface of tubular structures, and particularly vascular grafts, including an arrangement for holding the graft in an appropriate orientation for coating the internal surface thereof as well as arrangements for removing immediately, the solvent content of the polymer coating material applied to the internal surface of the graft.

Other objects and advantages of this invention will be apparent from the following description, the accompanying drawings and the appended claims.

DETAILED DESCRIPTION OF THE INVENTION

Figure 1:
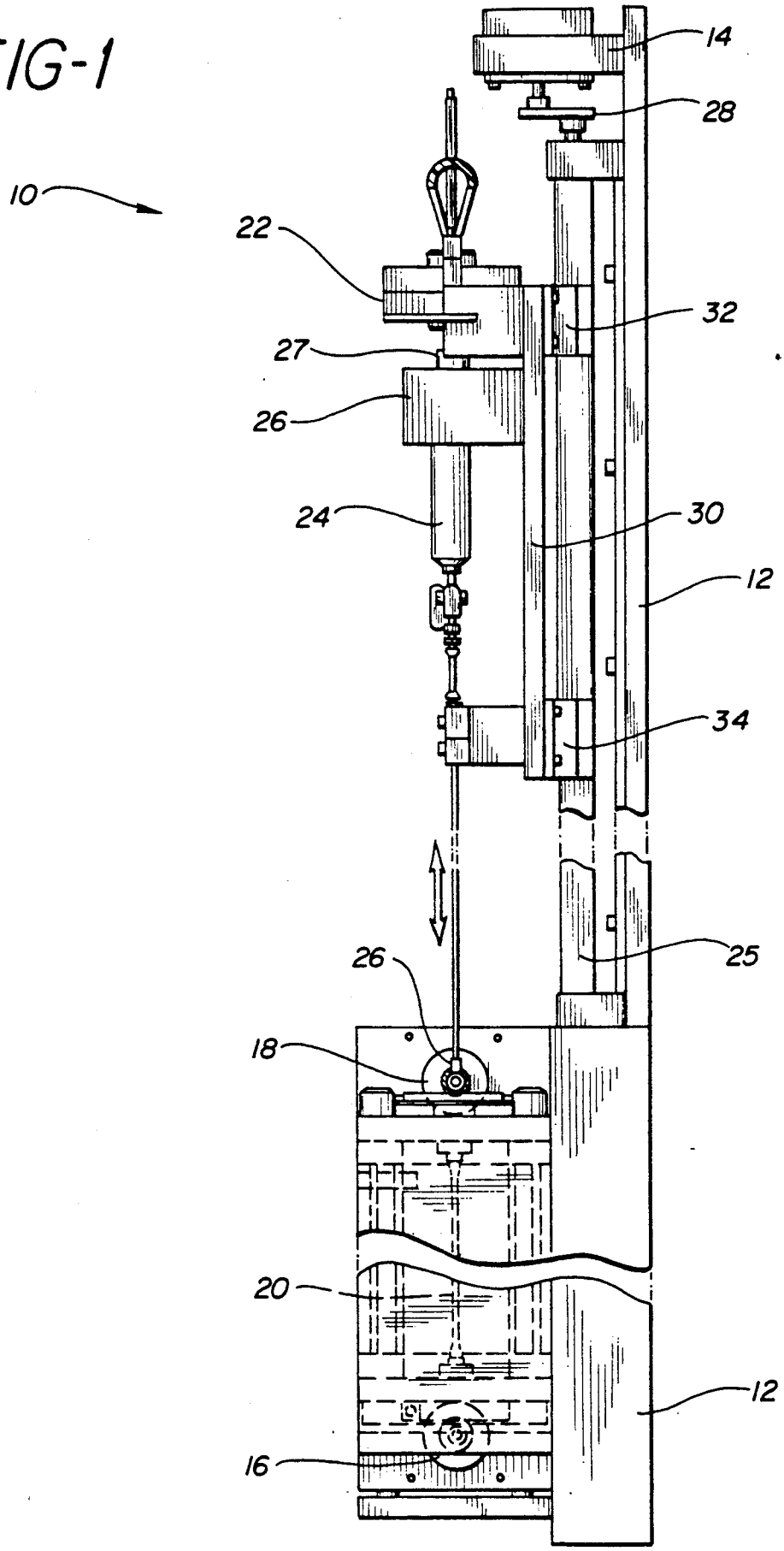
FIG. 1 is a side elevational view of apparatus for coating the internal surface of a vascular graft, and illustrating the overall apparatus of the invention.
Figure 2:
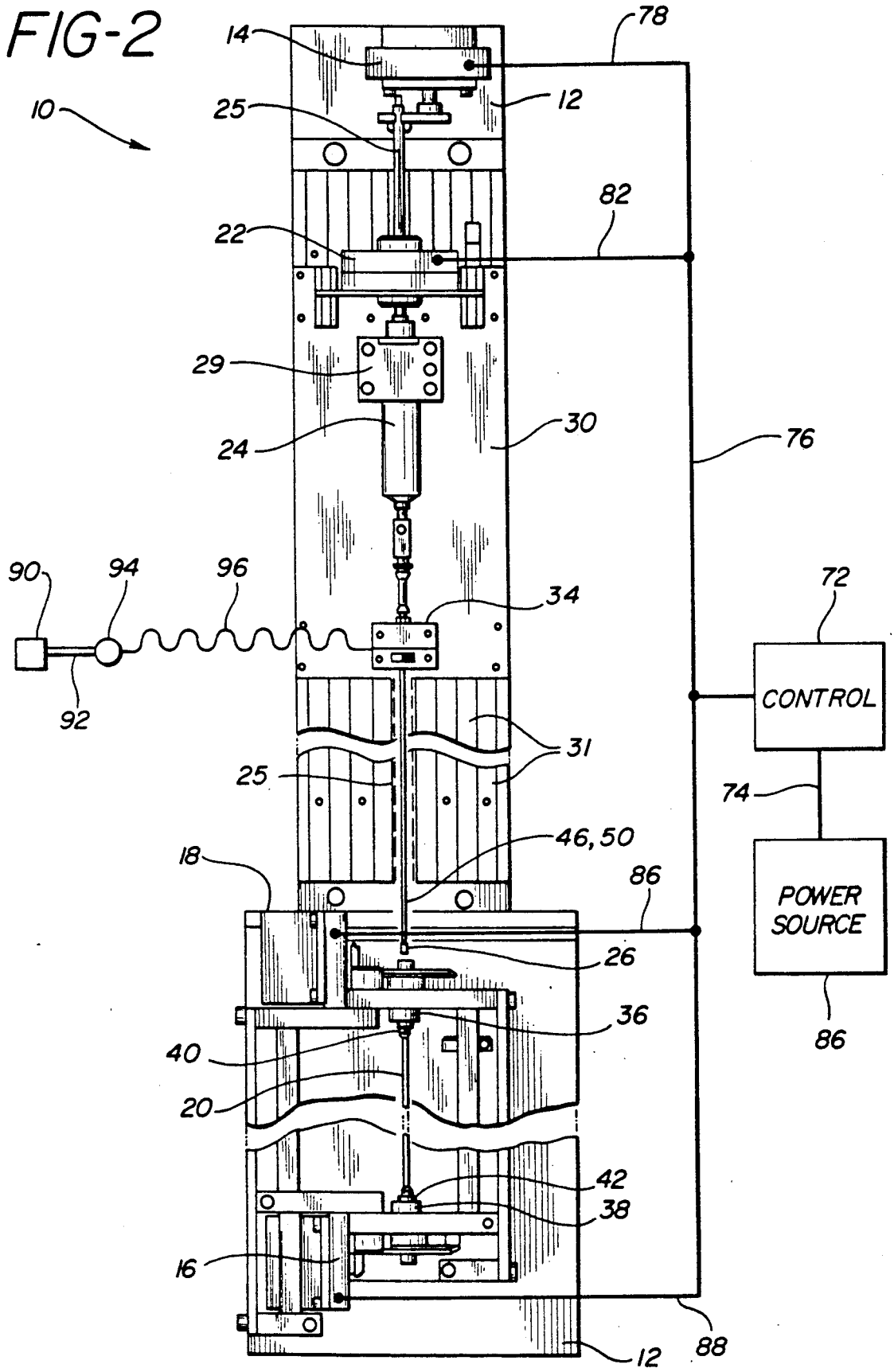
FIG. 2 is a secondary side elevational view of the apparatus of FIG. 1 taken from the right hand side thereof.

Referring to the drawings in which like reference characters refer to like parts throughout the several views thereof, FIGS. 1 and 2 illustrate the invention as employed in coating a vascular graft and the arrangement for holding the graft in position for that purpose including the arrangement for movement of the applicator versus the graft during the coating procedure.

As shown in FIGS. 1 and 2, the device 10 includes a support platform structure 12 for supporting the arrangement in a vertical orientation so that the tube itself to be coated is positioned in a vertical orientation relative to the coating apparatus moving therethrough. As can be seen in FIGS. 1 and 2, stepper motors 16 and 18 rotate the graft while coating takes place. Each stepper motor has applied thereto a barb holding shaft 36, 38, respectively, with each such barb holding shaft having a barb 40, 42, respectively, attached thereto for holding the graft 20 in proper position for movement of the coating apparatus 26 therethrough.

Stepper motor 14 has connected thereto, through appropriate gearing 28, a lead screw 22 for movement of platform 30 upwardly and downwardly on rails 31.

The syringe 24 is mounted on platform 30 for feeding the polymer coating material to coating head 26. Stepper motor 22, in this connection, is connected to platform 30 for incorporating a threaded rod within its housing. Motor 22 turns the rod providing linear motion of the rod and is used to push the plunger of syringe 24 to deliver at an appropriate rate the polymer material to be coated on the internal surface of graft 20. Each of the stepper motors is operated and energized through a control 72 from a source of power 80 through line 74 (not shown in FIG. 1 for clarity).

The stepper motors operate through lines 76, 78, 82, 86 and 88 in an appropriate manner to not only rotate the graft during the coating operation in a proper sequence of rotational speed relative to the movement of the coating apparatus 26, but also they provide the linear movement of coating apparatus 26 in a controlled manner through the graft for the coating, while providing appropriate pressurized feed of the polymer material from syringe 24 to the applicator 48 and, if desired, an appropriate pressurized water spray head 44 for washing away the solvent immediately following the application of the coating.

A source of water 90 supplies water to water spray head 44 (FIGS. 2, 3 and 4) through line 92, pump 94 and a flexible water line 96 to junction block 34 connected to water spray head 44.

Figure 3:
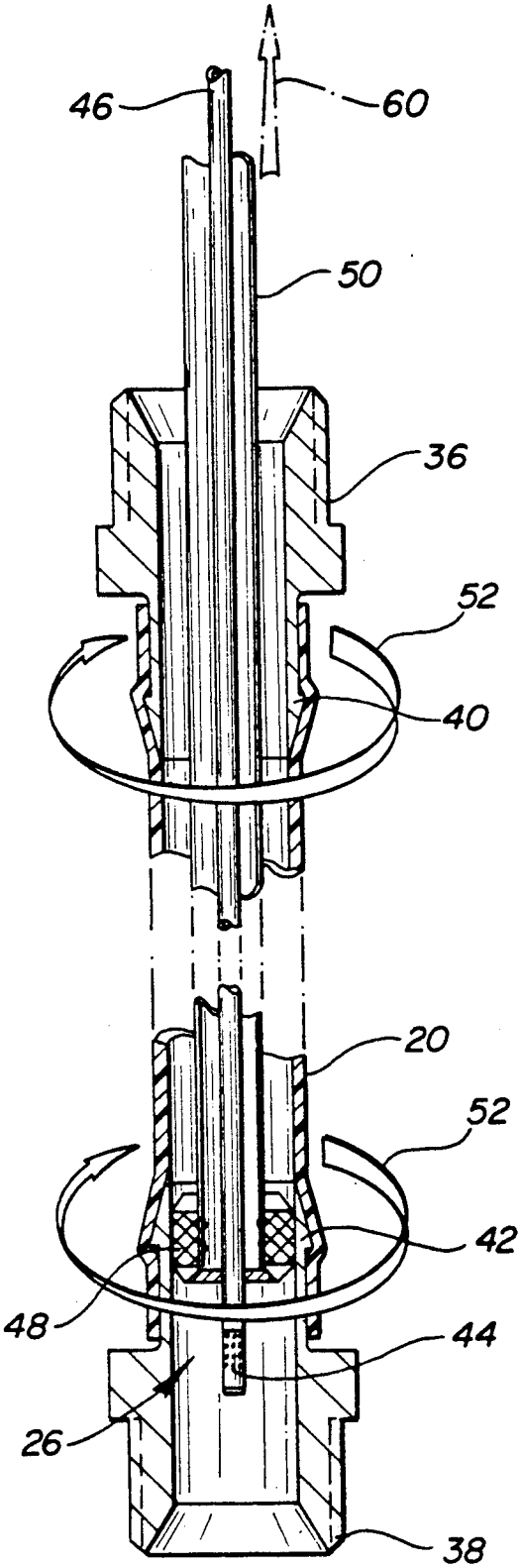
FIG. 3 is an enlarged sectional view of the coating apparatus of the invention illustrating its positioning within a vascular graft to be coated and showing the arrangement for holding the graft in position for the coating procedure.

Referring now to FIG. 3, an enlarged coating apparatus 26 is shown incorporating a polymer feed applicator 48 and a water spray head 44. As shown, graft 20 is held in place at each end by barbs 40, 42. Water is fed through line 46 from water source 90 to water spray head 44, while polymer is fed through line 50 from syringe 24 to the polymer applicator head 48.

Figure 4:
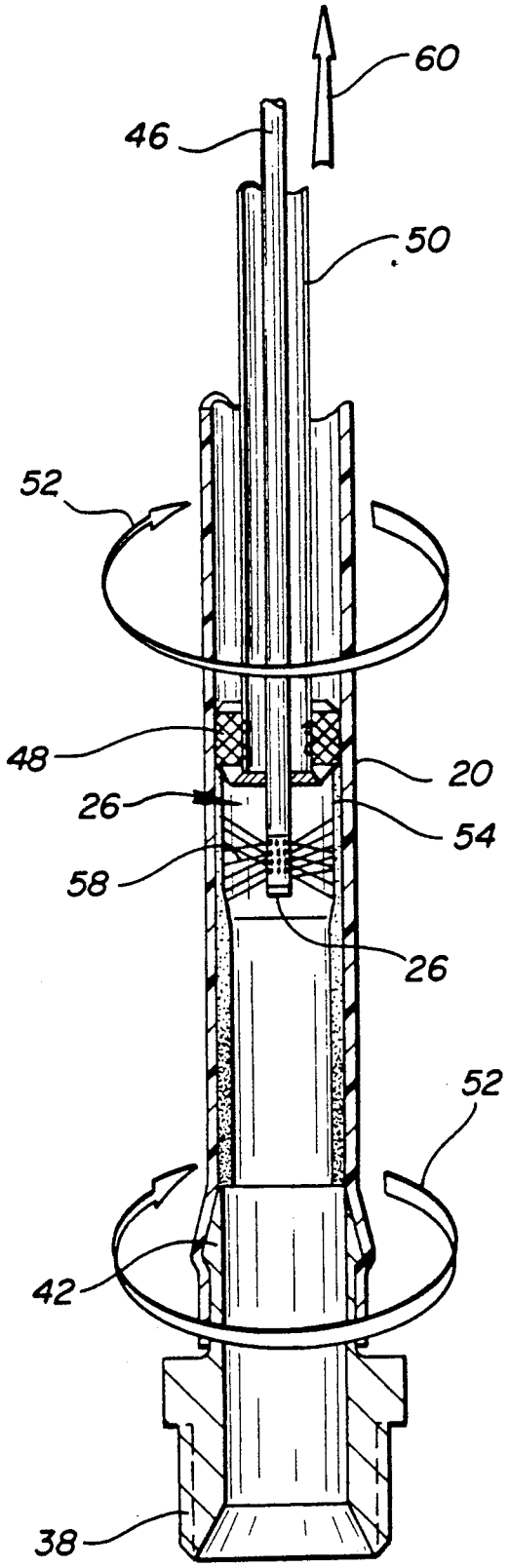
FIG. 4 is a sectional view of the apparatus of FIG. 3 showing the arrangement in a different position thereof applying the coating and the water spray simultaneously, in accordance with one embodiment of the invention herein.

During the coating procedure, it is appropriate to move the combined coating apparatus 26 with no feed longitudinally through the graft to be coated until the spray head moves out of the end of graft 20 shown in FIGS. 1 and 2. Subsequently, the stepper motors are actuated in appropriate manner for moving the coating apparatus longitudinally upwardly through graft 20 for application of initially a polymer coating 54 and for application of a water spray 58 immediately after to wash away the solvent for immediately setting the final polymer coating on the internal surface of the tube 20. As illustrated in FIGS. 3 and 4, the movement of the spray head is according to arrow 60 while the rotation of the graft during this longitudinal movement of the spray head is by rotation illustrated by the arrows 52.

Figure 5:
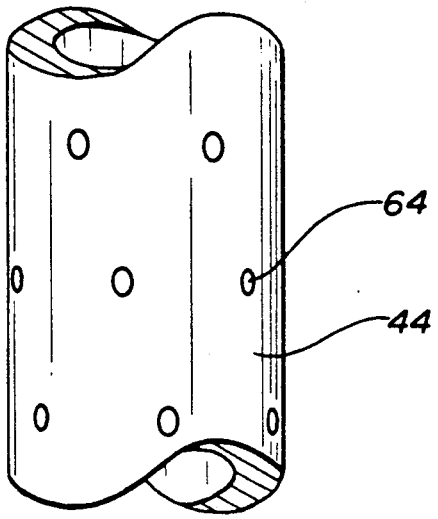
FIG. 5 is a side elevational view broken away of one portion of the water spray head illustrating the positioning of the water spray holes for spraying the polymer coating once it has been applied.
Figure 6:
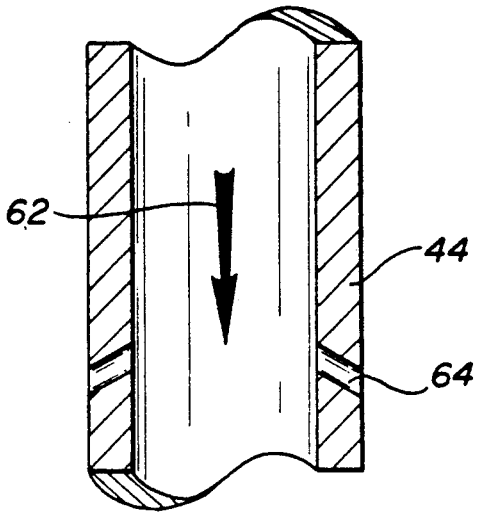
FIG. 6 is a sectional view of the water spray head portion of FIG. 5 showing detailed positioning of water spray bores.

As a further feature of the invention, the water spray head 44 is configured to provide the appropriate controlled amount of water spray to the already applied coating The purpose of this is to provide a controlled amount of water, while at the same time not disturbing the coating once it has been applied. For this reason, a water spray head such as that shown in spray head 44 shown in FIGS. 5 and 6 has downwardly positioned orifices such as illustrated in the cross sectional view indicated at 64 in FIG. 6. The flow of water is illustrated by the arrow 62.

Figure 7:
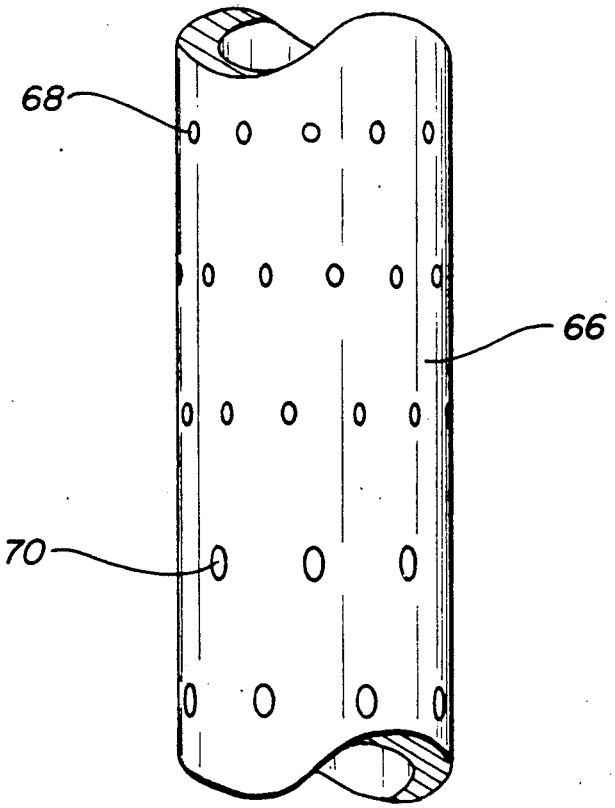
FIG. 7 is a side view of a further embodiment of water spray head partially broken away.

A further embodiment of spray head is shown in FIG. 7 wherein the orifices become larger toward the end of the spray head such as illustrated at 68 and 70 in FIG. 7. Thus, the initial application of water spray to the polymer coating is more subdued through the orifices 68, whereas once the solvent has been initially extracted from the coating and partial setting takes place, a larger spray in quantity with less force can be passed through the orifices 70.

As purely illustrative of one application of the method and apparatus herein, and as discussed above in a general sense, a vascular graft may be coated internally in accordance with this invention. A representative coating material is polyurethane, for example, which may be made up with a solvent which is water soluble, such as dimethylacetamide or dimethylformamide. It is appropriate that the graft, which may be polytetrafluoroethylene, be oxidized prior to coating in order for the surface to receive the precise coated material required in proper form and degree in order to maintain the graft in appropriate condition for use.

In application of the coating material, a 10 or 20 cc syringe 24 may be used and removed from its package. The syringe is prepared for appropriate application of the coating procedure herein including taking the stopper from the syringe and mounting it on the stainless steel plunger, not shown, which is part of the equipment attached to stepper motor 22 and its associated support structure 29 on movable platform 30. The syringe is then filled with the coating material selected, which may be polyurethane as discussed above.

Once the syringe barrel has been mounted in appropriate position, stepper motor 22 may be activated to position the syringe barrel for pumping the polymer solution through the device to applicator 48. Then stepper motors 16 and 18 are set to the desired speed for graft rotation through the main control module 72. Also, the desired speed is set for the stepper motor 14 to control the rate at which the combined coating apparatus 26 moves through graft during the coating procedure.

Subsequently, graft 20 is mounted on the barbs 42, 40 as shown in FIG. 3, for example so that there is no slack in the graft, but also with no undue tension.

Thereafter, coating apparatus 26 is moved longitudinally through the graft to a position outside or below the lower end of the graft prior to coating. This is done by appropriate movement of stepper motor 14 for that purpose. Then the desired speed of stepper motor 22 is set in order to achieve the proper delivery rate through polymer spray head 48 of coating apparatus 26. This is done by observing the actual delivery rate through applicator 48 prior to its passage through graft 20.

Thereafter, stepper motors 16, 18 are activated for rotating the graft prior to the longitudinal movement of coating apparatus 26 through the graft to be coated. At this point, the coating polymer is still being pumped out of applicator 48 even though it is outside the graft.

Thereafter, stepper motor 14 is activated for pulling the combined coating apparatus 26 through graft 20. This movement is continued until the coating apparatus 26 reappears outside the upper end of graft 20, positioned as shown in FIGS. 1 and 2.

As will be understood by practitioners-in-the-art, the graft is then removed from the device and appropriate procedures are taken for maintaining the graft in proper condition for subsequent use including further flushing of the graft to remove any residual solvent and heating in an oven at an elevated temperature for a period of time.

Further, as purely illustrative of representative speeds of the stepper motors utilized in the above procedure, stepper motors 16, 18 may be set, for example, at 11 revolutions per minute during the coating procedure, whereas stepper motor 22 may be set to move at 2.4 mils per minute, and stepper motor 14 at 30 inches per minute. A representative drip rate for this proposed sequence of movement and time is one drop every five seconds of polymer material from polymer applicator 48.

It should be understood that the procedure discussed above is representative only of methods and apparatus of the invention herein. Obviously, the apparatus can be modified for coating a variety of dimensions of a tubular object for a controlled coating of the internal surface thereof. The invention is particularly appropriate, as discussed previously, for coating the internal surface of very elongated objects versus the diameter of the object involved.

Accordingly, and as will be apparent from the foregoing, there are provided in accordance herewith, methods and apparatus for the precise, controlled coating internally of longitudinal tubular objects. The invention, as will be understood by practitioners in the art is particularly appropriate for the very precise and required detailed control of a coating on the internal surface of a vascular graft. With such an arrangement, such small dimensional objects may be coated internally for a variety of applications as discussed above where this precise control is required.

With the vast number of operations being conducted on a daily basis, the methods and apparatus herein are particularly appropriate and useful for providing the properly controlled coatings necessary for such sensitive applications.

While the methods and apparatus herein disclosed form preferred embodiments of this invention, this invention is not limited to these specific methods and apparatus, and changes can be made therein without departing from the scope of this invention which is defined in the appended claims.

What is claimed is:

1. Apparatus for coating the internal surface of tubes, comprising (a) a source of power;

(b) power control means connected to said source of power;

(c) a base support (d) a source of liquid coating material;

(e) an applicator head mounted on said base support for movement longitudinally through a tube to be coated, said applicator head connected to said source of coating material;

(f) a pair of spaced apart tube support means mounted on said base support, each said tube support means including means for grasping one end of a tube to be coated;

(g) first and second stepper motor means connected to said power control means; each of said first and said second stepper motor means connected to a respective one of said spaced apart tube support means for rotating a tube mounted between said spaced apart tube support means;

(h) third stepper motor means mounted on said base support and connected to said power control means; said third stepper motor means connected to said source of coating material for forcing said coating material through said applicator head; and (i) fourth stepper motor means connected to said power control means; said fourth stepper motor means connected to said applicator head, said source of coating material, and said third stepper motor; said fourth stepper motor means provides means for movement of said applicator head, said source of liquid coating- material and said third stepper motor longitudinally of said base support for causing said applicator head to move longitudinally through a rotating tube mounted on said spaced apart tube support means;

(j) whereby said power control means controls said first, second, third and fourth stepper motor means in order to rotate a tube mounted in said spaced apart tube support means while moving said applicator head longitudinally through the mounted tube and said applicator head coating material on the internal surface of that mounted tube from said source of coating material.

2. The apparatus of claim 1, in which (a) said applicator head is a dual applicator;

(b) said dual applicator comprises;

(1) a liquid coating material applicator head; and
(2) a water spray head;
(c) a source of water for said water spray head; and
(d) flow communication means extending between said source of water and said water spray head.

3. The apparatus of claim 2, in which
(a) said water spray head follows said liquid coating material applicator head in the movement thereof through a tube to be coated.

4. The apparatus of claim 3, in which
(a) said liquid coating material is a polymer in a solvent.

5. The apparatus of claim 1, further comprising
(a) a plurality of rails positioned on one surface of said base support;
(b) a movable platform mounted for movement on said rails;
(c) said source of liquid coating material, and said third stepper motor means mounted on said movable platform; and
(d) said fourth stepper motor means connected to said movable platform for the movement thereof along said rails.

6. The apparatus of claim 1, in which
(a) said source of liquid coating material is a syringe; and
(b) said syringe being connected to said third stepper motor means.

7. The apparatus of claim 1, in which
(a) said liquid coating material applicator head is comprised of a member selected from the group consisting of sintered brass, porous ceramic material, sintered zinc/nickel alloy and stainless steel.

8. Apparatus for coating the internal surface of a tube comprising
(a) a source of power;
(b) power control means connected to said source of power;
(c) a base support;
(d) a plurality of rails positioned on one surface of said base support;
(e) a platform movable along said rails;
(f) a pair of spaced apart tube support means mounted on said base support with each of said tube support means including means for grasping one end of a tube to be coated;
(g) a source of liquid coating material mounted on said movable platform;
(h) an applicator head mounted in said movable platform for movement longitudinally through a tube to be coated, said applicator head connected to said source of coating material; and
(i) a plurality of stepper motor means connected to said power control means to control movement of said movable platform, each of said spaced apart tube support means, and said source of coating material;
(j) whereby said control means, controls said plurality of stepper motor means in order to rotate a tube mounted on said spaced apart tube support means while moving said platform to cause said applicator head to move longitudinally through that mounted tube and said applicator head is caused to apply coating material on the internal surface of that mounted tube from said source of coating material.

9. The apparatus of claim 8, in which
(a) said applicator head is a dual applicator head;
(b) said dual applicator head comprises;
(1) a liquid coating material applicator head; and
(2) a water spray head;
(c) a source of water for said water spray head; and
(d) flow communication means extending between said source of water and said water spray head.

10. The apparatus of claim 9, in which
(a) said water spray head follows said liquid coating material applicator head in the movement thereof through a tube to be coated.

11. The apparatus of claim 10, in which
(a) said liquid coating material is a polymer in a solvent.

12. The apparatus of claim 8, in which
(a) said source of liquid coating material is a syringe; and
(b) said syringe being connected to said plurality of stepper motor means.

13. The apparatus of claim 8, in which
(a) said liquid coating material applicator head is comprised of a member selected from the group consisting of sintered brass, porous ceramic material, sintered zinc/nickel alloy and stainless steel.

* * * * *